United States Patent [19]

Muller et al.

[11] 4,127,257

[45] Nov. 28, 1978

[54] PROCESS FOR OPERATING A PLURALITY OF REGENERATIVE HOT BLAST STOVES FOR SUPPLYING HOT BLAST TO A BLAST FURNACE

[75] Inventors: Rudolf Müller, Merzenich; Josef Seeger; Konrad Fink, Düren, all of Germany

[73] Assignee: Hermann Rappold & Co. GmbH., Duren, Fed. Rep. of Germany

[21] Appl. No.: 802,194

[22] Filed: May 31, 1977

Related U.S. Application Data

[63] Continuation-in-part of Ser. No. 776,371, Mar. 10, 1977, abandoned.

[51] Int. Cl.[2] ..... C21B 9/10

[52] U.S. Cl. ..... 266/44; 266/82; 266/87

[58] Field of Search ..... 266/44, 82, 87, 88, 266/138, 139, 197

[56] References Cited

U.S. PATENT DOCUMENTS

| | | | |
|---|---|---|---|
| 3,153,532 | 10/1964 | Touzalin | 266/88 X |
| 3,178,160 | 4/1965 | Walther et al. | 266/88 X |

FOREIGN PATENT DOCUMENTS

| | | | |
|---|---|---|---|
| 4,920,842 | 5/1974 | Japan | 266/44 |

*Primary Examiner*—Joseph H. McGlynn

*Assistant Examiner*—Paul A. Bell

*Attorney, Agent, or Firm*—Wenderoth, Lind & Ponack

[57] ABSTRACT

A plurality of regenerative hot blast stoves are operated under a staggered-parallel process wherein each stove is alternately operated under a fixed heating cycle wherein no cold blast is supplied to the stove and no hot blast issues therefrom and a fixed blasting cycle wherein cold blast is supplied to the stove and issues therefrom as hot blast. The initiation of the cycles of the stoves is staggered in time with respect to each other such that at any given time hot blast issues from more than one of the stoves but at different temperatures. The temperature of the hot blast issuing from the stoves is regulated to a predetermined temperature required at the blast furnace in a two-stage operation including a first stage wherein relatively cooler and warmer hot blast issuing from those stoves operating under blasting is mixed and controlled as a function of a first reference temperature greater than the temperature required at the blast furnace, and a second stage wherein cold blast is admixed with the hot blast mixture and controlled as a function of a second reference temperature equal to the temperature required at the blast furnace. Upon a lowering of the second reference temperature due to an operating requirement of the blast furnace, the first reference temperature is raised, whereby the second stage temperature regulation overlaps the first stage temperature regulation.

1 Claim, 5 Drawing Figures

STAGGERED PARALLEL OPERATION

PARALLEL OPERATION

TANDEM OPERATION

PROCESS FOR OPERATING A PLURALITY OF REGENERATIVE HOT BLAST STOVES FOR SUPPLYING HOT BLAST TO A BLAST FURNACE

This is a continuation-in-part of application Ser. No. 776,371, filed Mar. 10, 1977 now abandoned.

BACKGROUND OF THE INVENTION

The present invention relates to a process for operating a group of regenerative hot blast stoves for heating cold blast from a constant supply source and for supplying the thus formed hot blast at a selectively variable predetermined temperature and at a constant volume to a blast furnace. The present invention is particularly directed to such a process wherein the temperature of the hot blast is regulated to the temperature required at the blast furnace in a two-stage operation. In a first stage, hot blast issues from more than one of the stoves, but at relatively cooler and warmer temperatures. These different temperature blasts are mixed, and this mixing is regulated as a function of a first reference temperature which is greater than the temperature required at the blast furnace. In a second stage, this hot blast mixture is admixed with cold blast as a function of a second reference temperature which equals the temperature required at the blast furnace.

As is well known, hot blast, i.e. air which is heated to a high temperature in hot blast stoves, is supplied to a blast furnace for the purpose of carrying out combustion and reduction operations within the blast furnace. Typically a plurality of hot blast stoves are alternately regenerated and employed for the purpose of supplying such hot blast. Conventionally such hot blast stoves are operated in accordance with three different processes.

When the installation is operated in accordance with the "parallel" process, half of the hot blast stoves are operated simultaneously for a predetermined length of time to supply hot blast to the blast furnace, while the other half of the hot blast stoves are operated during the same predetermined length of time to be heated. When the first stoves are switched from blasting to heating, then the other half of the stoves are simultaneously switched from heating to blasting. During the operation of the hot blast stoves in accordance with the parallel process, the temperature of the hot blast which is supplied to the blast furnace is regulated by admixing therewith cold blast as a function of the temperature required at the blast furnace.

The second known process is the "tandem" process, and when the installation is operated under this process, each hot blast stove is operated under blasting for a predetermined length of time and is then operated under heating for a further predetermined length of time. The cycling of the blast periods of the hot blast stoves is in a tandem manner with normally only one hot blast stove operating under blasting at a given time, or when a plurality of hot blast stoves are operating under blasting, their blasting cycles correspond in time with respect to each other. During the operation of the hot blast stoves in accordance with the tandem process, the hot blast supplied to the blast furnace is also admixed with cold blast as a function of the temperature required at the blast furnace.

Both of the parallel and tandem processes are recognized to have the disadvantage in that each of the hot blast stoves is required to operate throughout the entire blasting cycle thereof at a temperature higher than the temperature required at the blast furnace.

This disadvantge can however be overcome by operating the hot blast stoves in accordance with the third known type of process, i.e. the "staggered-parallel" process. When operating the installation in accordance with the staggered-parallel process, each of the hot blast stoves is operated under blasting for a predetermined length of time and then operated under heating for a predetermined length of time. However, the cycles of the hot blast stoves are staggered in time with respect to each other such that at any given time hot blast issues from more than one of the stoves but at different temperatures. The temperature of the hot blast issuing from the stoves is regulated to the temperature required at the blast furnace in a two-stage operation. In a first stage, the relatively cooler and warmer hot blasts issuing from those stoves operating under blasting are mixed, and this mixing is controlled as a function of a first reference temperature which is greater than the temperature required at the blast furnace. During a second stage, the hot blast mixture has admixed thereto cold blast, and this admixing operation is controlled as a function of a second reference temperature corresponding to the temperature required at the blast furnace.

However, operation of the installation in accordance with the staggered-parallel process suffers from a further disadvantage which has not been solved in the art prior to the present invention.

Specifically, when it is necessary to drastically reduce the second reference temperature over a short period of time, the second stage temperature regulation operation inherently requires a greater amount of cold blast. This results in the second stage temperature regulation operation using at least a portion of the cold blast which would otherwise be supplied to those hot blast stoves which are operating under blasting. Therefore, the hot blast which issues from the hot blast stoves is inherently at an increased temperature which is at a sufficiently high level that it is no longer possible to perform the first stage temperature regulation operation. That is, the relatively warmer and cooler hot blasts issuing from the hot blast stoves are all at a temperature such that it is impossible to regulate the mixture of such blasts to the first reference temperature.

The result of this phenomenon is that the first stage temperature regulation operation becomes completely inoperative, and the entire temperature regulation must be achieved only by the second stage temperature regulation operation. Thus, when it becomes necessary due to the requirements of the blast furnace to drastically lower the second reference temperature, the hot blast stove installation cannot be operated under the staggered-parallel process, and thus the advantages thereof are lost.

SUMMARY OF THE INVENTION

With the above discussion in mind, it is the primary object of the present invention to provide an improvement of the above described staggered-parallel process such that, even when the second reference temperature is drastically lowered during a short period of time, the hot blast stove installation will still be operated under the above described two-stage temperature regulation.

This object is achieved in accordance with the present invention, in that, when it becomes necessary to reduce the second reference temperature due to an operating requirement of the blast furnace, the first reference temperature is raised, with the result that the second stage temperature regulation operation overlaps the first stage temperature regulation, but that both stages remain operative.

Specifically, when the second reference temperature is drastically lowered over a short period of time, with the result that at least a portion of the cold blast which would otherwise be supplied to the hot blast stoves is rather used for the second stage temperature regulation operation, with the result that the hot blast issuing from the hot blast stoves operating under blasting becomes increased, the first reference temperature is raised. Specifically, the first reference temperature is raised simultaneously with the lowering of the second reference temperature. Therefore, even though the blast issuing from the hot blast furnaces is at a relatively increased temperature, the hot blast stoves may still be operated such that the hot blast issuing therefrom is regulated as a function of the now increased first reference temperature.

BRIEF DESCRIPTION OF THE DRAWINGS

Other objects, features and advantages of the present invention will be apparent from the following detailed description, taken with the accompanying drawings, wherein.

DETAILED DESCRIPTION OF THE INVENTION

Figure 1C:
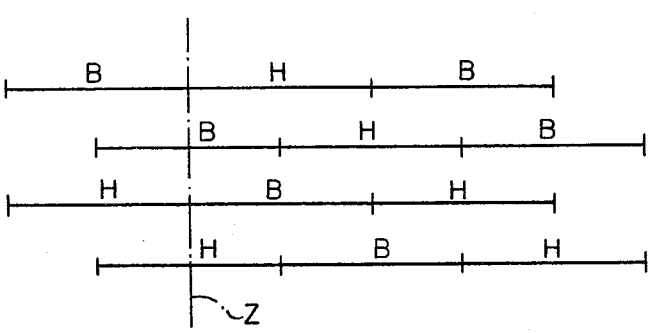
FIG. 1*c* is a nomograph similar to FIG. 1*a* and 1*b*, but illustrating the operation of the hot blast stoves when operated in accordance with a staggered-parallel process, i.e. the type of operation to which the present invention is directed.
Figure 1A:
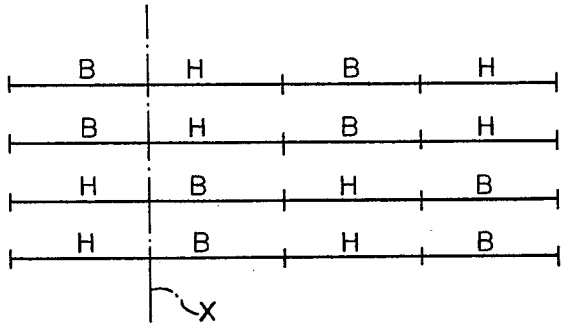
FIG. 1*a* is a schematic nomograph illustrating the blasting and heating cycles of hot blast stoves when operated in accordance with a parallel process.
Figure 1B:
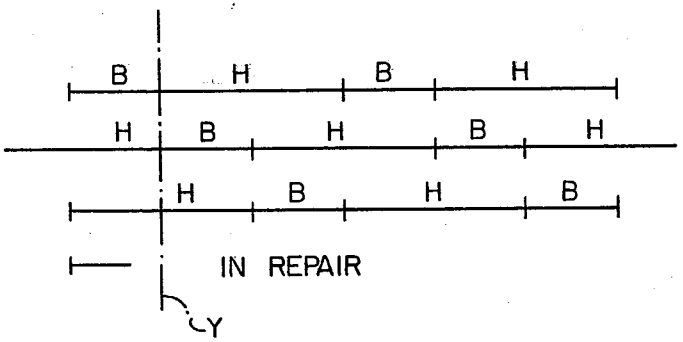
FIG. 1*b* is a nomograph similar to FIG. 1*a*, but illustrating the operation of the hot blast stoves when operated in accordance with a tandem process.

Reference will initially be made to FIGS. 1*a*, 1*b* and 1*c* to illustrate the general sequence of operation of a plurality of regenerative hot blast stoves when operated in accordance with the known processes of parallel operation, tandem operation and staggered-parallel operation, respectively. In the following description and in the accompanying drawings reference is made to four hot blast stoves. However, it is to be understood that the present invention is applicable to the use of a plurality of hot blast stoves other than four to supply hot blast to a blast furnace.

With reference to FIG. 1*a*, when operating hot blast stoves 1, 2, 3 and 4 in accordance with a parallel process, two of the hot blast stoves are operated simultaneously for a predetermined length of time to supply hot blast to the blast furnace, while the other two hot blast stoves are operated during the same predetermined length of time to be heated. When the first two stoves are switched from blasting to heating, then the second two stoves are simultaneously switched from heating to blasting. For instance, again with reference to FIG. 1*a*, during the time period prior to switching time X, hot blast stoves 1 and 2 are operated under a blasting cycle, i.e. they simultaneously supply hot blast to the blast furnace. During this same predetermined length of time, for example forty-five minutes, blast stoves 3 and 4 are being heated. At the end of this predetermined time, i.e. at point of time X, hot blast stoves 1 and 2 are switched to heating, and hot blast stoves 3 and 4 are simultaneously switched to blasting. During the next predetermined time cycle, for example 45 minutes, the blast furnace is supplied with hot blast from hot blast stoves 3 and 4. During the operation of the hot blast stoves in accordance with the parallel process shown in FIG. 1*a*, the temperature of the hot blast which is supplied to the blast furnace is regulated by admixing therewith cold blast as a function of a predetermined required temperature of hot blast which is required at the blast furnace.

With reference now to FIG. 1*b* of the drawings, when the regenerative hot blast stoves are operated in accordance with a tandem process, each hot blast stove is operated under blasting for a predetermined length of time, for example thirty minutes, and then operated under heating for a further predetermined length of time, for example sixty minutes. The cycling of the blast periods of the hot blast stoves is however cycled in a tandem manner as shown in FIG. 1*b*. More particularly, as shown in FIG. 1*b*, during a time period immediately preceding point in time Y, hot blast stove 1 is shown as blasting, while hot blast stoves 2 and 3 are shown as being heated. Hot blast stoves 4 is shown as being shut down for repair. However, it is to be understood that hot blast stove 4 could be in operation, and the timing sequence would then be in tandem with stoves 1, 2 and 3. When point in time Y is reached, hot blast stove 1 is automatically shifted to heating and continues to heat for a predetermined time of for example 60 minutes. At point in time Y, hot blast stove 2 is automatically shifted to blasting and continues to blast for a further predetermined period of time, for example 30 minutes. Hot blast stove 3 continues to be heated for the remaining 30 minutes of its 60 minute heating cycle, at which time hot blast stove 3 would be automatically switched to blasting, hot blast stove 2 would be automatically switched to heating, and hot blast stove 1 would continue to be heated. During the operation of the hot blast stoves in accordance with the tandem process shown in FIG. 1*b*, the hot blast supplied to the blast furnace is regulated in the same manner as described above with regard to the parallel process of FIG. 1*a*. That is, the hot blast supplied from the particular hot blast stoves is admixed with cold blast as a function of a hot blast temperature required in the blast furnace.

The above described parallel and tandem processes are each recognized to have the disadvantage in that each of the hot blast stoves is required to operate throughout the entire blasting period thereof at a temperature higher than the temperature required at the blast furnace. That is, in both the parallel and tandem processes, each individual hot blast stove must be operated, during the entire blasting cycle thereof, at a temperature above the temperature of the hot blast required at the blast furnace.

The above disadvantage can however be overcome by operating the hot blast stoves in accordance with the staggered-parallel process, and with reference now to FIG. 1*c* of the drawings, this process will be described. Specifically, in the staggered-parallel process, each of the regenerative hot blast stoves is operated under blasting for a predetermined length of time, for example 60 minutes, and then operated under heating for a predetermined period of time, also for example 60 minutes. However, the cycles of the hot blast stoves are staggered in a manner such that during any given period of time hot blast is supplied from more than one hot blast stove, but not in a simultaneous manner. Rather, hot blast is continually supplied from more than one hot blast stove, but the hot blast stoves which are supplying hot blast are staggered in time with respect to each other. Specifically with reference to FIG. 1*c*, before a point of time Z, hot blast stove 1 has operated a complete blasting cycle of 60 minutes, but at point of time Z is switched to a heating cycle and then is heated for a complete cycle of 60 minutes. Previous to point of time Z, hot blast stove 2 has completed one-half, i.e. 30 minutes, of a blasting cycle, and after point of time Z continues the remaining 30 minutes of such blasting cycle. Prior to point of time Z, hot blast stove 3 has completed an entire heating cycle, and at point of time Z is switched to blasting whereafter it completes an entire blasting cycle. Prior to point of time Z hot blast stove 4 has completed one-half of a heating cycle, and after point of time Z continues being heated to complete such heating cycle. Accordingly, it will be apparent that at any given time hot blast is supplied from two hot blast stoves. However, the switching is never simultaneous, and it will be apparent that the temperatures of the blasts supplied from two hot blast stoves at a given point of time will be different. For example, at a point of time immediately after point Z, the hot blast supplied from hot blast stove 3 will be at a maximum temperature but at a minimum quantity. On the other hand, the temperature of the hot blast being supplied from hot blast stove 2 will be at a lesser temperature, but will involve larger quantities. Accordingly, it will be apparent that when operating the hot blast stoves in accordance with the staggered-parallel process, the hot blast of each hot blast stove need not be at a temperature above the temperature required at the blast furnace throughout the entire blasting cycle of each blast furnace. This is due to the fact that hot blast is supplied from more than one hot blast stove in staggered temperature conditions and is then admixed. Thus, while hot blast is being supplied at a maximum temperature from one hot blast stove, further hot blast may be supplied at a minimum temperature from a second hot blast stove.

Accordingly, during operation of the hot blast stoves in accordance with the staggered-parallel process, the temperature of the hot blast is regulated in two stages. In the first stage, hot blast at two different temperatures from two different hot blast stoves is mixed to form a first hot blast flow. The temperature of this first hot blast flow is regulated as a function of a first reference temperature value which is set at a level higher than the temperature of the hot blast required at the blast furnace. This regulated first hot blast flow is subsequently admixed with smaller amounts of cold blast as a function of a second reference value which corresponds to the required temperature of the hot blast at the blast furnace. That is, in the first stage of temperature regulation, the temperature of the mixed hot blasts from the hot blast stoves which are switched to blasting is adjusted to a level which is somewhat above the hot blast temperature which is required at the blast furnace. In the second stage of temperature regulation this first hot blast flow is then regulated to the final temperature required at the blast furnace, and this second hot blast flow is supplied to the blast furnace in a conventional manner.

Figure 2:
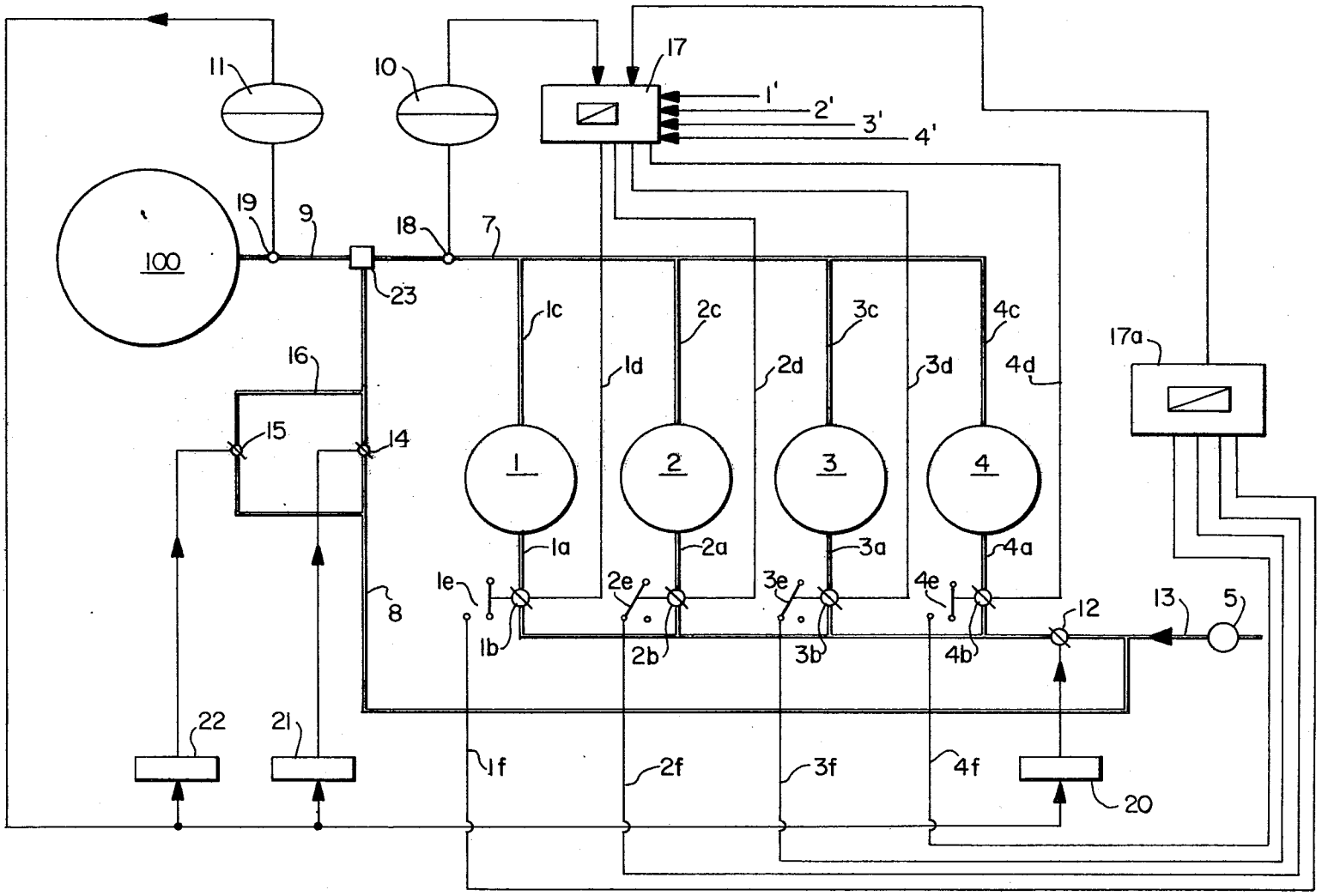
FIG. 2 is a schematic diagram of a blast furnace installation wherein a blast furnace is supplied with hot blast from hot blast stoves in accordance with a staggered-parallel operation.

With reference now to FIG. 2 of the drawings, an installation operating under the staggered-parallel process will be described. Particularly, a blast furnace 100 is supplied with hot blast at a required temperature by means of hot blast stoves 1, 2, 3 and 4 operating in accordance with the staggered-parallel process. Cold blast is supplied through a cold blast pipe 13 in which there is provided a volume governor or regulator 5 to ensure the maintenance of a constant amount of cold blast flowing through pipe 13. Cold blast is supplied to hot blast stoves 1 through 4 during the respective blasting cycles thereof via feed pipes 1*a*, 2*a*, 3*a*, and 4*a*, respectively. Feed pipes 1*a* through 4*a* have therein adjustable cold blast throttling valves 1*b*, 2*b*, 3*b* and 4*b*. respectively. During the respective blasting cycles of hot blast stoves 1 through 4, hot blast exits therefrom through hot blast removal pipes 1*c*, 2*c*, 3*c* and 4*c*, respectively, into a hot blast pipe 7. Hot blast from the particular hot blast stoves operating under their respective blasting cycles is admixed in hot blast pipe 7 to form a first hot blast flow.

The temperature of this first hot blast flow is regulated to be at a first reference value T1 (see FIG. 3), which is selected to be somewhat above the hot blast temperature T2 required at the blast furnace. This first temperature regulating stage is carried out in a known manner by measuring the temperature in hot blast pipe 7, for example by a temperature measuring device 18. The actual temperature measured in hot blast pipe 7 is compared to first reference temperature T1 by temperature regulator 10 which generates a signal representative of any difference therebetween. For instance, the greater the difference between the actual measured temperature and reference temperature T1, the greater the signal produced by temperature regulator 10.

The specific operating construction and parameters of temperature measuring device 18 and temperature regulator 10 do not in and of themselves form any portion of the present invention.

However, one specific type of temperature measuring device 18 may include a thermocouple and a millivolt to current converter. Specifically, temperature measuring device 18 may include a thermocouple attached to pipe 7 and capable of generating a millivolt signal representative of the temperature within pipe 7. Temperature measuring device 18 may additionally include a converter of the type manufactured by Honeywell Corporation under the name "Currentpak", Model No. NAX100, Spec. sheet YH-NA-ld, millivolt to current converter and capable of converting a millivolt signal from the thermocouple to a current signal ranging from, e.g., 4–20 mA, depending upon the magnitude of the millivolt signal received from the thermocouple. The linear millivolt input signal received from the thermocouple is passed through a measuring circuit and is converted into a millivoltage. A multi-section filter removes any prevailing a-c stray pickup, and the thus filtered millivolt signal is compared with a feedback voltage. The resultant d-c error signal enters a chopper inverter circuit where it is a-c to d-c converted and is fed to an amplifier. The amplified a-c signal is synchro-rectified and goes through an isolating transformer where it is diverged into two signals, i.e. the feedback signal and a signal to output circuits. Each diverged signal is then rectified and filtered, thereby producing the feedback voltage and an input voltage to a V/I converter which generates a proportional 4–20 mA d-c output signal.

It is specifically to be understood that the above type of temperature measuring device is exemplary only, and that other conventional temperature measuring devices capable of producing a proportional output signal may be employed.

A specific example of one type of temperature regulator 10 which may be employed is that manufactured by Yamatake-Honeywell Co., Ltd., under the brand name "Currentronik Vertical Scale Indicating Controller With Reset Limiter", Model No. NBL02-X-(YIA), Spec. sheet YH-NB-ld. This type of regulator device is capable of receiving the proportional d-c output from temperature measuring device 18, i.e. a signal of from 4–20 mA, and generating an output signal of from 4–20 mA, dependent upon the relative size of the input signal received from temperature measuring device 18. It is to be understood that the present invention is not limited to the use of a temperature regulator 10 of the above specifically described configuration. Rather, it is to be understood that any other known type of temperature regulator which is capable of generating a proportional signal may be employed.

Accordingly, the greater the temperature difference between the actual measured temperature and reference temperature T1, the greater will be the value of the electric signal generated by electronic temperature regulator 10. For example, if no difference exists between the actual measured temperature and reference temperature T1, regulator 10 will generate a signal of 4 mA. However, if a temperature difference does exist between the actual temperature and reference temperature T1, then a signal greater than 4 mA in proportion to the size of the detected temperature difference will be generated.

The signal generated by regulator 10 is passed to a relay station 17 which controls the opening and closing of throttle valves **1*b*–4*b* through respective lines 1*d*, 2*d*, 3*d* and 4*d*. The specific structure of relay station 17 in and of itself forms no portion of the present invention and is known in the temperature control of hot blast stoves operating under the staggered-parallel process. Thus, the structure of relay station 17 will not be described in detail. Relay station 17 is however of the type which initiates the opening and closing of valves 1*b*–4*b* at predetermined time intervals and in a predetermined sequence, as shown in FIG. 1*c* and in the lower portion of FIG. 3. Particularly, relay station 17 relays the signal from regulator 10 to the various valves 1*b*–1*b* at predetermined set time intervals. The magnitude of the signal from regulator 10, which is a function of the temperature difference between the actual measured temperature and reference temperature T1, is passed to the respective valves 1*b*–4*b* by relay station 17. The magnitude of the signal passed to respective valves 1*b*–4*b* may regulate the degree of opening and/or closing of such respective valves. In the lower portion of FIG. 3 of the drawings it is shown that the rate of opening of each of the respective valves is constant, with the rate of closing of the respective valves being varied dependent upon the magnitude of the signal passed thereto, to thereby regulate the amount of hot blast delivered from the respective hot blast stoves, and to thereby regulate the temperature of the hot blast mixture in hot blast line 7**. However, it should be understood that the rate of opening of each of the valves could be similarly varied.

Figure 3:
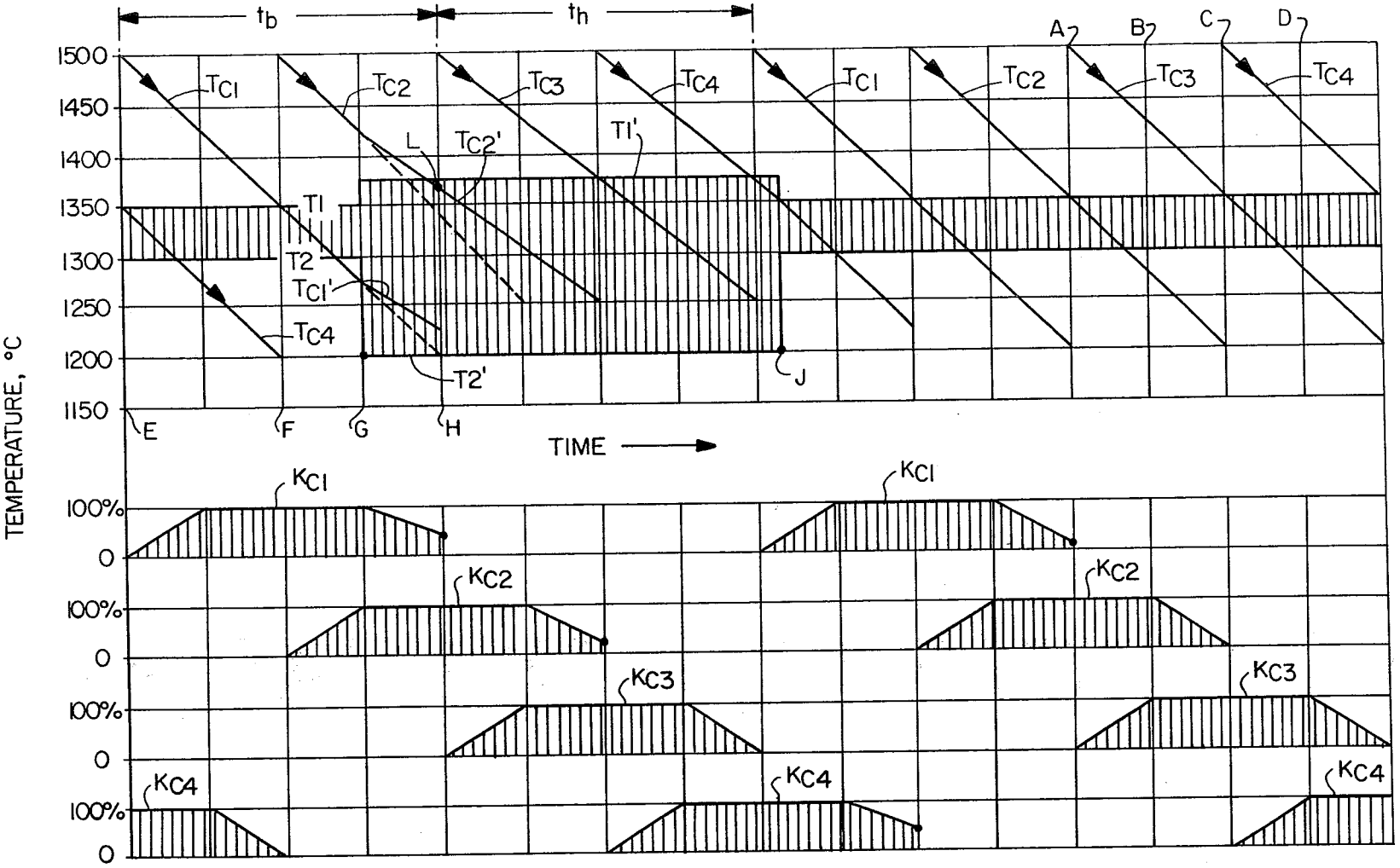
FIG. 3 is a nomograph illustrating hot blast stoves operating under the staggered-parallel process regulated in accordance with the process of the present invention, the upper portion of the nomograph of FIG. 3 illustrating the temperatures of the hot blasts issuing from the hot blast stoves as a function of time, and the lower portion of the nomograph of FIG. 3 illustrating the corresponding open-closed positions of the individual throttling valves controlling the respective hot blast stoves as a function of time.

With reference to FIG. 3 of the drawings, and particularly the right-hand portion thereof, simplified curves $T_{C1}$, $T_{C2}$, $T_{C3}$ and $T_{C4}$ illustrate the staggered time cycle as well as temperature drop of hot flow exiting from hot blast stoves 1–4, respectively. T1 represents the above discussed reference temperature which is somewhat higher than second reference T2 corresponding to the temperature of the hot blast required at the blast furnace. In the lower portion of FIG. 3, simplified curves $K_{C1}$, $K_{C2}$, $K_{C3}$ and $K_{C4}$ represent the open-closed positions of valves **1*b*–4*b*, respectively, during the respective blasting and heating cycles of hot blast stoves 1–4, respectively. It will be apparent from curves $T_{C1}$–$T_{C4}$ that the temperature of the hot blasts from the individual hot blast stoves need not be maintained above the temperature T2 required at the blast furnace throughout the entire individual blasting cycles. Rather, and with reference to point of time A in FIG. 3, relay station 17 closes throttle valve 1*b*, thereby switching hot blast stove 1 from blasting to heating. Hot blast stove 4 continues in its heating cycle. Hot blast stove 2 continues in its blasting cycle, with the temperature of the hot blast issuing therefrom reducing to a level below reference value T1. Throttle valve 2*b* remains in the fully opened condition, as shown by curve $K_{C2}$. Relay station 17 initiates opening of throttle valve 3*b*, thereby switching hot blast stove 3 from the heating cycle thereof to the blasting cycle thereof. At a point in time immediately after point A, hot blast will be supplied to hot blast line 7 from both of hot blast stoves 2 and 3, while hot blast stoves 1 and 4 are in their heating cycles. The temperature of the hot blast from hot blast stove 3 will be at a maximum, whereas the temperature of the hot blast from hot blast stove 2 will be substantially lower. However, since throttle valve 3*b* is still opening, the quantity of the higher temperature hot blast from hot blast stove 3 will be less than the quantity of hot blast from the lower temperature hot blast stove 2. Accordingly, the mixture of hot blast in line 7 will substantially remain at temperature T1. Any variation of the hot blast in line 7 from temperature T1 will be detected by regulator 10**.

At a predetermined time B after the initiation of the opening of valve **3*b*, as determined by predetermined command signal 3' programmed into relay station 17, valve 3*b* will reach its fully opened position. The time at which valve 3*b* becomes fully opened is detected so that the signal from regulator 10 is switched from valve 3*b* to valve 2*b* to cause closing of valve 2*b* at a rate dependent upon the magnitude of the signal generated by regulator 10. This may be achieved in various known manners. However, in the embodiment illustrated in FIG. 2 of the drawings, the movement of valve 3*b* to its fully opened position causes a limit or end position switch 3*e* to close a respective circuit 3*f* which causes a supplemental relay station 17*a* to transfer the signal from regulator 10 from valve 3*b* to valve 2*b*, thereby commencing the initiation of closing of valve 2*b*. As mentioned previously, the rate at which valve 2*b* moves from its fully open to its fully closed position will be dependent upon the magnitude of the signal transferred from regulator 10 to valve 2*b* via relay station 17. This rate of closing of valve 2*b*** will thus be regulated to control the amount of hot blast supplied to line 7 from hot blast stove 2 during the closing of valve 2*b*. Thereby, the temperature of the hot blast mixture in line 7 will be regulated.

The further operation of the elements shown in FIG. 2 will continue in accordance with the staggered-parallel process in the above explained manner. For example, at point C shown in FIG. 3 the programmed signal 4' supplied to relay station 17 will transfer the signal from regulator 10 from valve 2*b* to valve 4*b* to initiate opening thereof. At point of time D valve 4*b* will be in its fully opened position, thereby causing limit switch 4*e* to close circuit 4*f*, thus causing supplemental relay station 17*a* to activate relay station 17 to transfer the signal from regulator 10 from switch 4*b* to switch 3*b* to initiate the closing operation of switch 3*b*. The rate at which the closing of valve 3*b* will proceed will be dependent upon the magnitude of the signal transmitted thereto from regulator 10.

The staggered-parallel operation of hot blast stoves 1–4 and the continued first stage temperature regulation of the hot blast mixture in line 7 will continue in the above manner.

The second stage temperature regulation, i.e. the regulation to reduce the temperature of the hot blast from temperature T1 to temperature T2 required at the blast furnace, is achieved by a second temperature regulator 11 in response to a temperature measurement by temperature measuring device 19 in a second hot blast pipe 9 which receives the hot blast from first hot blast pipe 7. Cold blast may be supplied from cold blast supply pipe 13 through cold blast admixing pipe 8 and/or cold blast by-pass pipe 16 to an admixing point 23 between hot blast pipes 7 and 9. That is, temperature regulator 11 controls the amount of cold blast supplied at point 23 to adjust the temperature of the hot blast from temperature T1 to the temperature T2 required at the blast furnace.

It is to be understood that temperature measuring device 19 and temperature regulator 11 may be precisely the same type of elements as temperature measuring device 18 and temperature regulator 10, respectively, as discussed above. Alternatively, temperature measuring device 19 and temperature regulator 11 may be any known conventional such elements capable of producing necessary proportional signals.

This second stage adjustment may be carried out in several known manners. In the specific arrangement shown in FIG. 2, this is achieved by a regulated control of valve 12 arranged in cold blast supply pipe 13, a rough control valve 14 in cold blast admixing pipe 8 and a precise control valve 15 in by-pass pipe 16.

Temperature regulator 11 may be, as stated above, the same type of regulator as first temperature regulator 10. Thus, regulator 11 may be of the type which will always emit an electrical signal of from 4 to 20 mA, the precise magnitude of such signal being generally dependent on, for example proportional to, the difference between the temperature of the hot blast measured by temperature measuring device 19 and the temperature T2 required at the blast furnace. The actual signal from regulator 11 will be supplied to one of three divided or split range relay devices 20, 21 or 22, respectively operable to control the opening or closing of valves 12, 14 and 15, which may be of any type of known variably controlled throttle valve. More particularly, split range devices 20, 21 and 22 may each be of the type which is responsive only to a predetermined magnitude of signal. By designing the signal responsiveness of each of devices 20, 21 and 22 so as to be responsive to separate magnitude ranges of the signal from regulator 11, it is possible to selectively control the open-closed position of valves 12, 14 and 15.

One specific type of split range device which may be employed for devices 20, 21 and 22 is that manufactured by Yamatake-Honeywell Co., Ltd., under the brand name of "Split Range Currentpak Unit", Model No. NAX511, Spec. sheet YH-NA-8c. In this type of split range device, each such device may be designed to be operable only upon the receipt of a particular portion or range of possible input signals received from an input source. Specifically, assume that regulator 11 will generate a signal of from 4–20 mA as discussed above. Split range devices 20, 21 and 22 may be designed such that device 22 is actuatable only upon receipt of a signal of an amplitude of from 4 to 10 mA, device 21 may be designed to be operable only upon receipt of a signal of an amplitude of from 10 to 16 mA, and device 20 may be designed to be operable only upon receipt of a signal of an amplitude of from 16 to 20 mA. It is however to be understood that split range devices 20, 21 and 22 may be of a construction other than that specifically described above.

Additionally, the valves 12, 14 and 15 may each be of the type which is closed by a power cylinder assembly which is operated by a motor driver in proportion to the signal generated by the respective split range device 20, 21 or 22, to proportionally open or close respective valves 12, 14 and 15. One possible such motor driver is that manufactured by Yamatake-Honeywell Co., Ltd., Model No. NAX170, Spec. sheet YH-NA-17. This type of device is operable to receive and convert the signal of 4–20 mA from the respective split range device 20, 21 or 22 and to operate the respective power cylinder assembly by a proportional amount dependent upon the amount of the input signal received from the respective split range device. It is however to be understood that valves 12, 14 and 15 may be of a configuration other than that specifically described above, the important feature being that they control the amount of flow through respective lines 13, 8, and 16 in proportion to a temperature regulation signal.

The above operational characteristics of regulator 11 and split range devices 20, 21 and 22 will be explained in more detail below with reference to specific embodiments which are not intended to be limiting, but rather are exemplary only.

Specifically, as stated above, temperature regulator 11 may be designed to emit a signal of from 4 to 20 mA, dependent upon the temperature difference between the actual temperature measured by temperature measuring device 19 and the temperature T2 required at the blast furnace 100. That is, assume that the actual temperature measured by device 19 is 1450° C. Assume further that precise control valve 15 is closed except when opened by actuation of split range device 22, that split range device 22 is actuatable only upon receipt of a signal from regulator 11 of an amplitude of from 4 to 10 mA, and that split range device 22 generates a signal of a predetermined range, for example 4 to 20 mA, in proportion to the magnitude of the signal received.

Assume further that rough control valve 14 is normally closed and is opened only when split range device 21 is actuated. Assume yet further that split range device 21 is activated upon the receipt of a signal from regulator 11 of a particular range different from the range which actuates split range device 22. For example, split range device 21 may be operable when the signal from regulator 11 is from 10 to 16 mA. Assume yet further that split range device 21 always generates a signal within a predetermined range, for example 4 to 20 mA, and that the exact magnitude of this signal is proportionate to the magnitude of the actuating signal received from the regulator 11.

Assume further that split range device 20 is operable to generate a signal of a specific range, for example from 4 to 20 mA. Assume that split range device 20 is operable to receive a signal from regulator 11 only when such signal is of a predetermined range different from the ranges receivable by split range devices 21 and 22. For example, split range device 20 may be designed and/or adjusted to receive only a signal of from 16 to 20 mA. When the signal from regulator 11 is without the range of from 16 to 20 mA, then split range device 20 generates a signal equal to 4 mA, and control valve 12 remains fully open. When split range device 20 receives a signal of between 16 to 20 mA from regulator 11, then the signal generated by split range device 20 is proportionally increased to result in a proportional closing of control valve 12. However, control valve 12 must be set such that even at maximum signal generated by split range device 20 control valve 12 remains open to supply at least some cold blast to respective of the hot blast stoves 1–4. For example, control valve 12 may be set so that even at a maximum signal of 20 mA from split range device 20, control valve 12 still is opened at least a minimum amount, for example 30% opened.

With the above discussion in mind, the following specific examples will illustrate the manner in which the temperature of the hot blast in line 7 is reduced to a value corresponding to temperature T2 required at the blast furnace.

EXAMPLE 1

When T2 is 1350° C. and the actual temperature measured by temperature measuring device 19 is 1450° C., then the signal generated by temperature regulator 11 may be 9 mA. This size signal will not be received by split range devices 20 or 21, and thereby the signals generated by split range devices 20 and 21 will continue to be 4 mA. Thus, control valve 12 remains 100% open, and rough control valve 14 remains entirely closed. However, the signal of 9 mA from regulator 11 will activate split range device 22 and cause the signal generated thereby to be increased to about 17 mA. Thus, precise control valve 15 is activated to be opened to a position of approximately 83% open, whereby a relatively small amount of cold blast will be supplied from supply line 13, through cold blast admixing pipe 8 and by-pass pipe 16 to point 23 whereat such relatively small amount of cold blast is mixed with the hot blast from line 7 to reduce the temperature of such hot blast down to the required T2 temperature of 1350° C.

EXAMPLE 2

The actual temperature measured by temperature measuring device 19 remains 1450° C., but the temperature T2 required at the blast furnace is now reduced to 1250° C. The signal generated by temperature regulator 11 is proportionally increased to 14 mA. This signal is not received by split range devices 20 or 22, and accordingly such devices continue to generate signals equal to 4 mA. Thus, control valve 12 remains 100% open, and precise control valve 15 remains entirely closed. However, this signal of 14 mA from temperature regulator 11 is received by split range device 21 and causes the signal generated thereby to be increased to approximately 15 mA. This causes rough control valve 14 to be opened to a position of approximately 67% open. Accordingly, under the above circumstances, a relatively greater amount of cold blast is supplied from supply pipe 13 through cold blast admixing pipe 8 and valve 14 to point 23 to mix such relatively larger amount of cold blast with the hot blast from line 7 to reduce the temperature of the hot blast supplied to the blast furance to the reduced T2 temperature of 1250° C.

EXAMPLE 3

The actual temperature measured by temperature measuring device 19 remains 1450° C., however the T2 temperature required at the blast furnace is drastically reduced to 1150° C. This causes temperature regulator 11 to generate a substantially larger signal of 19 mA which is received by split range device 20 and causes the signal generated thereby to be increased to approximately 16 mA. This causes control valve 12 to be closed to a position until it is approximately only 53% open. Split range device 22 is operable to receive no portion of the signal from regulator 11, and thus precise control valve 15 remains closed. Split range device 21 is designed such that at signals above 16 mA, it will receive the signal generated by regulator 11, but will generate only the maximum possible signal therefrom, i.e. 20 mA, whereby rough control valve 14 remains 100% open. Thus, under this situation where the required temperature T2 of the blast furnace is drastically reduced, the cold blast necessary to achieve such a temperature is in substantial part taken from the cold blast which would otherwise be transferred to the hot blast stoves.

When the temperature T2 required at the blast furnace is raised, the above described control system will still remain operable, merely by raising the first stage reference temperature T1. Furthermore, when the temperature T2 required at the blast furnace is gradually reduced during a slow planned variation, no problems are encountered during the operation of the above system.

However, a severe operational problem occurs when the temperature T2 required at the blast furnace is drastically reduced for short periods of time, for example in the manner discussed above regarding Example 3. Specifically, when the temperature T2 required at the blast furnace is drastically reduced in a short amount of time by an amount such that control valve 12 is partially closed to supply a greater amount of cold blast to point 23, there of course inherently is less cold blast available to pass through the particular hot blast stoves which are operated under blasting. Thus, less heat is removed from the hot blast stoves operating under blasting. At such time as a given hot blast stove reaches the end of its blasting cycle, the temperature of the blast issuing therefrom is thereby made higher than would be the case if control valve 12 were fully open. When the next staggered hot blast stove is simultaneously switched to its blasting cycle, the hot blast supplied to line 7 is at such a temperature that it is impossible to reduce it to the previously set first reference temperature T1.

Accordingly, in the past when operating hot blast stoves according to the staggered-parallel process, at any such time that the temperature required at the blast furnace is drastically reduced over a short period of time, it basically becomes impossible to achieve the first stage temperature regulation by means of temperature regulator 10. Therefore, in the past, such a circumstance has generally resulted in the entire temperature control being achieved by the second stage only, i.e. by temperature regulator 11, and the control of valves **1*b*–4*b* by regulator 10 has been impossible. This is particularly true when considering the fact that in the past it has been considered to be operationally necessary to simultaneously lower first reference temperature T1 when lowering temperature T2** required at the blast furnace.

However, in accordance with the present invention the above severe operational problem is overcome by, rather than lowering first reference temperature T1 upon a lowering of temperature T2, the increasing of first reference temperature T1. The unique and unexpected advantage of this process operation will be described with reference to FIG. 3 of the drawings.

Specifically, time period $t_b$ represents the blasting cycle for hot blast stove 1, and time period $t_h$ represents the heating cycle for hot blast stove 1. It is to be remembered that the blasting and heating cycles of each of the hot blast stoves are equal and constant.

With regard to the left part of the upper portion of FIG. 3, hot blast stove 1 begins its blasting cycle at time period E under normal operating conditions whereat temperature T2 required by the blast furnace is set to be 1300° C. and first reference temperature T1 is set somewhat higher, i.e. at 1350° C. At this same time period E, hot blast stove 4 continues to be operated at its blasting cycle. At a later period in time, i.e. time period F, hot blast stove 2 is switched to blasting, and hot blast stove 4 is switched to heating, while hot blast stove 1 continues with its blasting cycle, the operation of the installation still being normal.

However, assume that at a later point in time, i.e. time period G, the temperature T2 required at the blast furnace is drastically reduced to 1200° C., and that this reduction is sufficient to cause control valve 12 to be at least somewhat closed, thereby restricting the amount of blast available for passage through hot blast stoves 1 and 2. Accordingly, upon the drastic reduction in a short amount of time of the temperature required at the blast furnace to the level T2', from the time period G the temperature reduction of the hot blast flows issuing from hot blast stoves 1 and 2 do not follow the normal curves $T_{C1}$ and $T_{C2}$, but rather are cooled at a lesser rate as indicated by the curves $T_{C1}$, and $T_{C2'}$.

That is, during the time period G–H, i.e. when hot blast stove 1 is being switched from blasting to heating by closing of valve **1*b*, the signal supplied to valve 1*b* from regulator 10 attempts to retard the closing of switch 1*b* so that a greater quantity of relatively lower temperature blast may be supplied to line 7. However, due to the fact that valve 12 has been partially closed, there is insufficient cold blast supplied to hot blast stove 1 and thus line 7. Further, at time period H, i.e. when hot blast stove 1 is switched to heating and hot blast stove 3 is switched to blasting, the combined temperature of the blast from hot blast stoves 2 and 3 is so high that it is impossible for regulator 10, by regulation of valve 2*b*, to control the temperature of the hot blast in line 7 to be equal to original first reference temperature T1. Therefore, upon the drastic reduction of temperature T2 required by the blast furnace, in accordance with prior known processes, first temperature regulator 10 would become incapable of performing the first stage temperature control. The result would be that the entire temperature control would be achieved only by regulator 11**.

However, it has totally uniquely been discovered in accordance with the process of the present invention that rather than leaving first reference temperature T1 unchanged, or even reducing such temperature as would be considered normal in the prior art, upon the drastic reduction of temperature T2 required by the blast furnace, the first reference temperature is simultaneously increased from value T1 to a value T1' at least as high as and preferably higher than the actual temperature L of the blast issuing from hot blast stove 2. Therefore, by raising the first reference value in the above manner, it again becomes possible for temperature regulator 10 to achieve a regulated exhausting of the hot blast stoves. Therefore, it still becomes possible to operate the installation in the staggered-parallel manner by a two-stage temperature control operation. Thereafter, at a later time period such as time period J, when the temperature required at the blast furnace is returned to its normal operating level, the first reference temperature may again readily be lowered from T1' to T1.

In accordance with the above described process operation of the present invention, the heat demand can be brought to approximately the same value as prior to the lowering of the temperature required at the blast furnace, and the control system of temperature regulator 10 will continue to remain operable.

It is of course to be understood that the manner of adjusting reference temperature T2 to T2', and similarly the manner of adjusting reference temperature T1 to level T1' would be readily understandable to those skilled in the art, and that temperature regulators 11 and 10, respectively, would clearly be designed to be capable of such adjustment.

It is once again further emphasized that the specific devices employed to achieve the above described control features are not in and of themselves the present invention. Such specific structural devices are known to those skilled in the art. Rather, the present invention is directed to the process feature of raising the first reference temperature upon a necessary substantial reduction of the temperature of the hot blast required at the blast furnace in a short period of time, particularly such a reduction which would result in a partial closing of control valve 12, such that the amount of cold blast available to the hot blast stoves is reduced. Those skilled in the art will understand from the above discussion the specific electrical and mechanical components employable in carrying out the above described staggered-parallel operation of the hot blast stoves. It is further to be understood that other types of control devices other than those specifically described above and which are known in the art may be employed to achieve the staggered-parallel operation.

What is claimed is:

1. In a process for operating a plurality of regenerative hot blast stoves for heating cold blast from a constant supply source and for supplying the thus formed hot blast at a selectively variable predetermined temperature and at a constant volume to a blast furnace, the stoves being operated under a staggered-parallel process wherein each stove is alternately operated under a fixed heating cycle wherein no cold blast is supplied to the stove and no hot blast issues therefrom and a fixed blasting cycle wherein cold blast is supplied to the stove and issues therefrom as hot blast, the hot blast issuing from each stove progressively decreasing in temperature during the blasting cycle thereof, said fixed heating cycles and said fixed blasting cycles of said stoves being initiated by selective closing and opening, respectively, of throttle valves positioned in pipes connecting said cold blast supply source to each of said stoves, the initiation of the cycles of the stoves being staggered in time with respect to each other such that at any given time hot blast issues from more than one of said stoves but at different temperatures, the temperature of the hot blast issuing from the stoves being regulated to said predetermined temperature in a two-stage operation including a first stage comprising mixing relatively cooler and warmer hot blast issuing from those stoves operating under blasting and controlling said mixing by regulating the closing and opening of said throttle valves as a function of a first reference temperature greater than said predetermined temperature to thereby maintain the thus formed hot blast mixture at said first reference temperature, and a second stage comprising admixing cold blast from said source with said thus formed hot blast mixture and controlling said admixing as a function of a second reference temperature equal to said predetermined temperature, the improvement wherein: upon a sudden lowering of said second reference temperature necessitated by operating requirements of the blast furnace, such lowering of said second reference temperature causing said second stage temperature regulation to use for said admixing at least a portion of the cold blast from said source which would otherwise be supplied to those stoves operating under blasting, thereby increasing the temperature of said hot blast issuing from said stoves to an extent such that it becomes impossible for said first stage temperature regulation to maintain said hot blast mixture at said first reference temperature by regulating the closing and opening of said throttle valves, and such that said throttle valves are not completely closed at the initiation of the heating cycles of the respective stoves, said first reference temperature is raised to an increased first reference temperature by an amount such that, even at the increased temperatures of said hot blast issuing from said stoves, said first stage temperature regulation can maintain said hot blast mixture at said increased first reference temperature, and such that said throttle valves are completely closed at the initiation of said heating cycles of said respective stoves.

* * * * *